US006351947B1

(12) United States Patent
Keller et al.

(10) Patent No.: US 6,351,947 B1
(45) Date of Patent: Mar. 5, 2002

(54) COMBUSTION CHAMBER FOR A GAS TURBINE

(75) Inventors: Jakob Keller, deceased, late of Wohlen, by Maria Keller-Schärli, legal representative; Georg Keller; Vera Keller, both of Wohlen, all of (CH)

(73) Assignee: ABB Alstom Power (Schweiz) (CH)

( * ) Notice: Subject to any disclaimer, the term of this patent is extended or adjusted under 35 U.S.C. 154(b) by 0 days.

(21) Appl. No.: 09/543,079

(22) Filed: Apr. 4, 2000

(51) Int. Cl.[7] ..... F02G 7/24
(52) U.S. Cl. ..... 60/725
(58) Field of Search ..... 60/725, 754, 752

(56) References Cited

U.S. PATENT DOCUMENTS

| | | | | |
|---|---|---|---|---|
| 2,654,219 A | | 10/1953 | Zaba | |
| 3,848,694 A | * | 11/1974 | Jannot et al. | 181/220 |
| 4,109,459 A | * | 8/1978 | Ekstedt et al. | 60/39.66 |
| 4,833,881 A | * | 5/1989 | Vdoviak et al. | 60/725 X |
| 5,373,695 A | | 12/1994 | Aigner et al. | |
| 5,431,018 A | | 7/1995 | Keller | |
| 5,644,918 A | | 7/1997 | Gulati et al. | |
| 5,765,376 A | * | 6/1998 | Zarzalis et al. | 60/752 X |
| 5,941,076 A | * | 8/1999 | Sandelis | 60/754 |

FOREIGN PATENT DOCUMENTS

| | | | |
|---|---|---|---|
| EP | 0576717 A1 | | 1/1994 |
| EP | 0669500 A1 | | 8/1995 |
| EP | 0702141 A2 | | 3/1996 |
| EP | 0892216 A1 | | 1/1999 |
| EP | 0 971 172 A1 | * | 1/2000 |
| GB | 2309296 A | | 7/1997 |
| RU | 2 117 806 C1 | * | 8/1998 |

* cited by examiner

*Primary Examiner*—Timothy S. Thorpe
*Assistant Examiner*—William H Rodriguez
(74) *Attorney, Agent, or Firm*—Burns, Doane, Swecker & Mathis LLP

(57) ABSTRACT

In a combustion chamber for a gas turbine, noise absorption is achieved over a wide frequency range with simultaneous cooling of the arrangement and low space requirement by the inner wall being formed, at least in a partial region of the inner walls by at least two perforated plates arranged essentially parallel to one another, and by the distances between the perforated plates and the geometrical dimensions of the openings being selected in such a way that a plurality of mutually connected Helmholtz resonators is formed and that, in addition, further expedients are available which act to absorb noise.

15 Claims, 9 Drawing Sheets

COMBUSTION CHAMBER FOR A GAS TURBINE

FIELD OF THE INVENTION

The present invention relates to the field of gas turbines. It concerns a combustion chamber for a gas turbine, in which combustion chamber the hot combustion gases of a combustion zone are surrounded by inner walls which are cooled by cooling air, which is introduced through cooling air ducts outside the inner walls, which cooling air ducts are formed by an outer wall of the combustion chamber and the inner walls.

Such a combustion chamber is known, in the form of a secondary combustion chamber from, for example, the publication EP-A1 0 669 500 by the applicant.

BACKGROUND OF THE INVENTION

In the combustion chambers, in particular the secondary combustion chambers, of conventional gas turbines, pressure vibrations or acoustic vibrations can occur in operation under certain conditions, these vibrations being located in the frequency range of several kHz, for example in the range from 2 to 6 kHz. Such vibrations are found to interfere with the operation and are therefore undesirable. One possibility for damping or suppressing such vibrations consists in providing fluid mechanics means in the combustion chamber which influence the flow of the hot gases in such a way that the acoustic vibrations are not excited or are only excited to a small extent. Another possibility consists in attaching, to the combustion chamber, so-called Helmholtz resonators which are coupled as elements damping the vibrations or making them disappear completely.

Various examples for the employment of Helmholtz resonators are known from the prior art. An annular combustion chamber for a gas turbine is described in the publication U.S. Pat. No 5,373,695. In this, individual Helmholtz resonators flushed with cooling air are arranged on the end surface near the burners. These Helmholtz resonators each comprise an external damping volume which is connected to the combustion chamber via a damping tube and is subjected to cooling air from the outside via a thin supply tube in order to prevent frequency detuning due to heat.

A gas turbine combustion chamber is described in the publication U.S. Pat. No. 5,644,918 in which, within the double shell supplying cooling air and surrounding the combustion chamber and at the end surface of the combustion chamber in the region of the burners, Helmholtz resonators 48 and 56 are formed by inserting additional partitions which are connected to the combustion chamber via contractions 50 and 58 but are otherwise completely closed so that there is no flow of cooling air through the resonator spaces.

Another solution which relates specially to a secondary combustion chamber is presented in the publication U.S. Pat. No. 5,431,018. A Helmholtz resonator flushed with cooling air surrounds, concentrically in this case, the fuel line which enters radially into the combustion chamber and through which the fuel for reheat is sprayed into the combustion chamber.

The known solutions operating with Helmholtz resonators are complex in design, can only be retrofitted to existing gas turbines with difficulty, occupy a substantial amount of space when a plurality of them are employed and are not compatible with cooling concepts in which the inner wall of the combustion chamber is cooled by cooling air introduced from outside. In addition, solutions with the use of Helmholtz resonators usually exhibit the disadvantage that their noise absorption profile covers a rather narrow band of the frequency range and cannot approximately cover the typically relevant range, mentioned above, of 2 to 6 kHz. Although the resonators can be differently tuned individually or in groups, which then leads to an inhomogeneous distribution of the absorption profile, such a solution has the inherent disadvantage that less power can be absorbed at a particular frequency.

SUMMARY OF THE INVENTION

Accordingly, one object of the invention is to provide a novel acoustically damped combustion chamber for gas turbines by means of a combination of Helmholtz resonators and a noise-absorbing perforated plate, which combustion chamber avoids the disadvantages of the known solutions and is distinguished, in particular, by little additional complexity and space requirement for the integrated resonators and, at the same time, permits effective cooling of the inner walls of the combustion chamber, and which exhibits the widest possible noise absorption profile in the frequency range.

The object is achieved in a combustion chamber of the type mentioned at the beginning wherein, at least in a partial region of the inner walls, the inner wall is formed from at least two perforated plates arranged essentially parallel to one another, wherein a first perforated plate borders directly on the cooling air ducts and is provided with a plurality of first openings through which cooling air from the cooling air ducts flows into a first intermediate volume located behind the first perforated plate, wherein a further perforated plate is arranged behind the first perforated plate, in the direction of the combustion zone, which further perforated plate is provided with a plurality of further openings, wherein the distance between the first perforated plate and the further perforated plate and the geometrical dimensions of the further openings are selected in such a way that the openings, together with intermediate volumes present between the perforated plates, form a plurality of mutually connected Helmholtz resonators and act as noise dampers for acoustic vibrations occurring in the combustion chamber, and wherein in addition further means are present which act to absorb noise. The core of the invention therefore consists in the fact that the combination of Helmholtz resonators with further noise-absorbing means leads to a wide noise absorption characteristic with little space requirement.

A first preferred embodiment of the invention is one in which, at least in a partial region of the inner walls, the inner wall is formed from three perforated plates arranged essentially parallel to one another, wherein a first perforated plate borders directly on the cooling air ducts and is provided with a plurality of first openings through which cooling air from the cooling air ducts flows into a first intermediate volume located behind the first perforated plate, which first intermediate volume is bounded, on the side facing toward the cooling air ducts, by the first perforated plate and, on the opposite side, by a second perforated plate, which second perforated plate is provided with a plurality of second openings, wherein a third perforated plate is arranged on the side of the second perforated plate facing away from the first intermediate volume, which third perforated plate is provided with a plurality of third openings and borders on the combustion zone, and wherein at least one of the perforated plates in addition acts to absorb noise. In other words, the core of the embodiment includes that one of the three perforated plates exhibits noise transmission which is as free from reflection as possible due to corresponding perforation arrangement or corresponding contraction ratio and that the combination and the geometric configuration of two further perforated plates creates a plurality of mutually connected Helmholtz resonators which cause a phase rotation. In addition, the complete absorption system is flushed by cooling air so that the resonators are stabilized thermally and in terms of frequency. The additional outlay to create the absorption system then—if the large openings in the inner wall are already present in the case of existing effusion cooling—only includes the provision of two further perforated plates.

A second preferred embodiment of the combustion chamber according to the invention is one in which the contraction ratio, defined as the ratio between the area of the opening and the area located in front of it in the direction of the combustion zone, is essentially the same for the second or the third openings as the maximum Mach number occurring in the combustion space, which is defined as the ratio of the source velocity and the sonic velocity, and wherein the perforated plate provided with such openings acts in a noise-absorbing manner. In this way, either the second or the third perforated plate becomes the noise-absorbing plate because the transmission is adjusted to be echo-free, independently of frequency, by the selection of the perforations.

A third preferred embodiment of the combustion chamber according to the invention is one in which the distance between the first perforated plate and the second perforated plate and the geometrical dimensions of the second openings are selected in such a way that the second openings, in combination with the first intermediate space arranged between the first and the second perforated plates, provide Helmholtz resonators whose resonant frequency is essentially located within the range of the acoustic vibrations occurring in the combustion space, and wherein the third perforated plate is preferably also configured to absorb noise. Thus the third perforated plate leads to an echo-free transmission of the noise and the Helmholtz resonators located behind, in the noise propagation direction, displace its phase.

For the usual frequency values of the combustion chamber vibrations, in the range from 2 to 6 kHz, the second perforated plate has a thickness in the range from 0.1 to 1 cm, in particular preferably 0.6 cm, the area ratio of the acoustically relevant partial areas of the first intermediate volume and the areas of the second openings is in the range from 5 to 10, in particular preferably 8, the distance of the first from the second perforated plate is 0.1 to 1 cm, in particular preferably 0.6 cm, the product of the contraction ratio of the third openings and the maximum Mach number is in the range from 1 to 0.5, and the area ratio of the acoustically relevant partial areas in the combustion space and the acoustically relevant partial areas of the first intermediate volume is in a range from 1 to 2.

Another preferred embodiment of the combustion chamber according to the invention is one in which the distance between the first perforated plate and the third perforated plate and the geometrical dimensions of the third openings are selected in such a way that the third openings, in combination with the intermediate space arranged between the first and the third perforated plate, provide Helmholtz resonators whose resonant frequency is essentially located within the range of the acoustic vibrations occurring in the combustion space, and in which the second perforated plate is also preferably configured to absorb noise. This produces a noise-absorbing arrangement in which the noise-absorbing perforated plate is arranged in the actual damping volume of the Helmholtz resonators; this is found to be space-saving and nevertheless efficient.

The noise-absorbing arrangement can be provided with a particularly space-saving configuration and optimum cooling technology without any essential impairment from the acoustic point of view if, in accordance with a further embodiment, the second and the third perforated plates are joined directly together with no distance apart and have a uniform and concentric arrangement of the perforations in the two perforated plates or if the two perforated plates are even replaced by a single perforated plate with perforations of different diameters drilled from the two sides.

BRIEF DESCRIPTION OF THE DRAWINGS

Preferred embodiments of the invention are disclosed in the following description and illustrated in the accompanying drawings, in which.

DETAILED DESCRIPTION OF THE INVENTION

Figure 1:
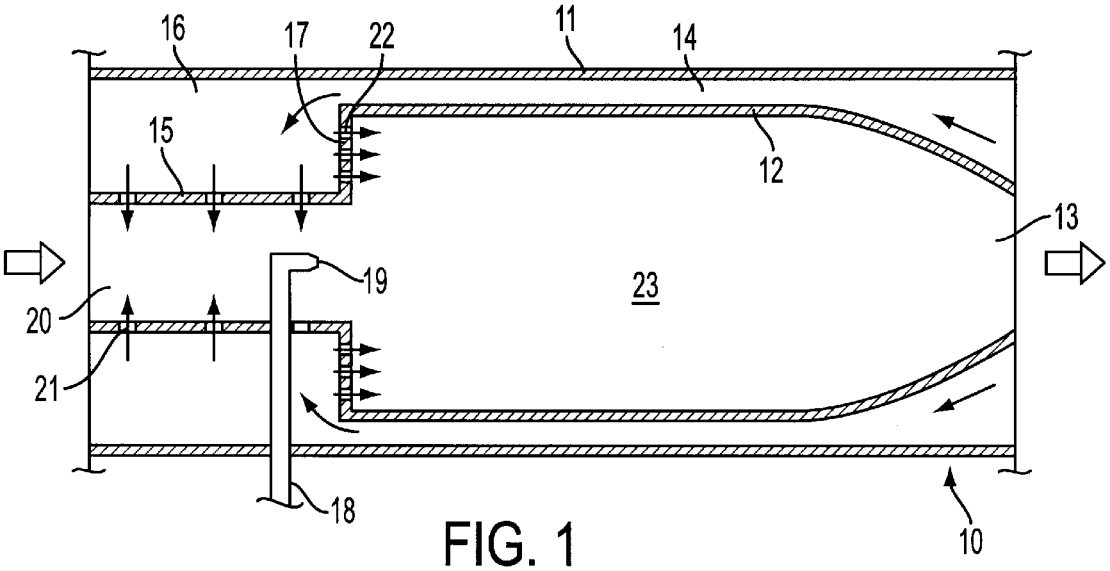
FIG. 1 (PRIOR ART)
FIG. 1 shows, in a simplified longitudinal section, a secondary combustion chamber such as is known from the prior art, in particular from EP-A1 0 669 500.

Referring now to the drawings, wherein like reference numerals designate identical or corresponding parts throughout the several views, FIG. 1 shows, in simplified longitudinal section, a secondary combustion chamber which is known from EP-A1 0 669 500 and which is advantageously suitable for carrying out the invention. The combustion chamber 10 includes a combustion zone 23, which is bounded by an inner wall 12 extending in the axial direction and by a radial inner wall 17. The hot gases from an upstream combustion stage enter the combustion zone 23 through an inlet zone 20 and leave again through a hot gas outlet 13. The inlet zone 20 is bounded by an inner wall 15. A fuel lance 18 protrudes into the inlet zone 20 from the side and, at its front end, this fuel lance has a nozzle 19 for injecting fuel. The inner walls 12, 15 and 17 are surrounded by an outer wall 11 extending in the axial direction. A cooling air duct 14 remains free between the inner wall 12 and the outer wall 11 and cooling air flows through this cooling air duct, against the flow direction of the hot gases, in a rear cooling air duct 16 formed between the inner wall 15 and the outer wall 11. The inner wall 12 is convectively cooled in the process by the cooling air. From the rear cooling air duct 16, cooling air flows through openings 21 in the inner wall 15 into the inlet zone 20, and through further openings 22 in the radial inner wall 17 into the combustion zone 23, providing effusion cooling in the process.

Figure 2:
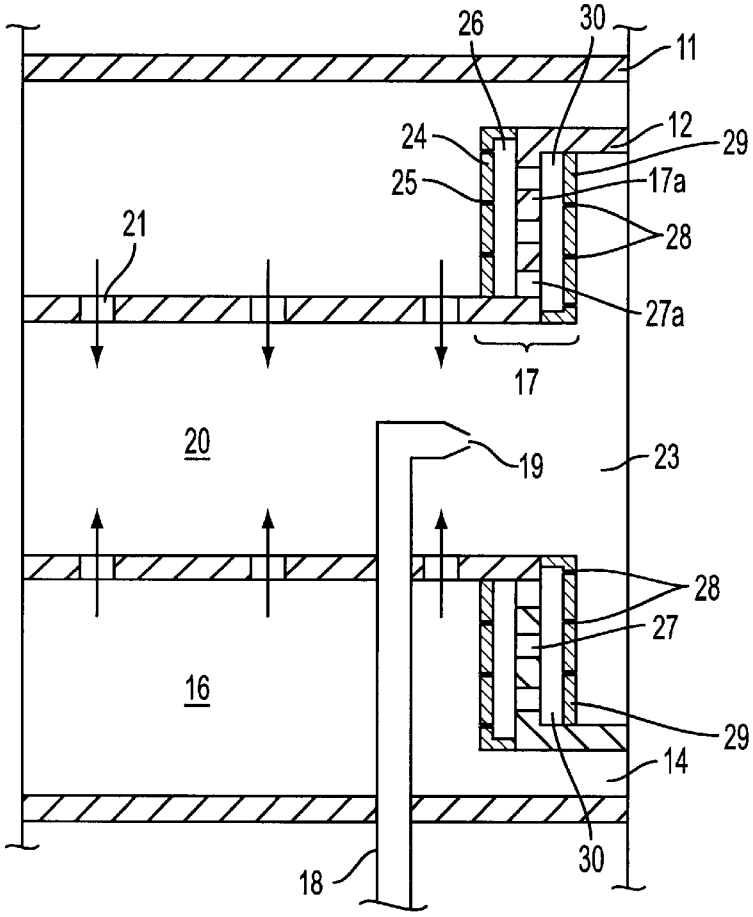
FIG. 2 shows an enlarged excerpt from the combustion chamber of FIG. 1 in the region of the step-type transition between inlet zone and combustion zone with an integrated Helmholtz resonator arrangement and an externally arranged damping diaphragm in accordance with a preferred embodiment example of the invention.

On the radial inner wall 17, i.e. the step-type widening between the inlet zone 20 and the combustion zone 23, it is now possible—in accordance with a preferred embodiment example of the invention, such as is shown in FIG. 2—to integrate a Helmholtz resonator arrangement in combination with a noise-absorbing third perforated plate 29, which simultaneously ensures effective cooling of the arrangement. On the outside of the previous radial inner wall 17*a,* a first perforated plate 24 is arranged in parallel and at a distance (L in FIG. 4) for this purpose, as is shown in FIG. 2. This first perforated plate 24, together with the actual radial inner wall, which forms a second perforated plate 17*a,* encloses a first (annular) intermediate volume 26. The second perforated plate 17*a* has a plurality of more or less uniformly distributed openings 27*a,* which can be identical to the openings 22 for the effusion cooling in the combustion chamber of FIG. 1 but can also have different geometrical dimensions. The openings 27*a,* which are configured as through-holes with a diameter a and a length I (FIG. 4), each independently act as the damping tube of a Helmholtz partial resonator which is formed from the respective opening 27*a* and the partial volume of the first intermediate volume 26 located behind it. The first intermediate volume 26 in total and the totality of the openings 27 a can be considered as individual Helmholtz resonators whose individual damping volumes are connected together to form the first intermediate volume 26.

Figure 4:
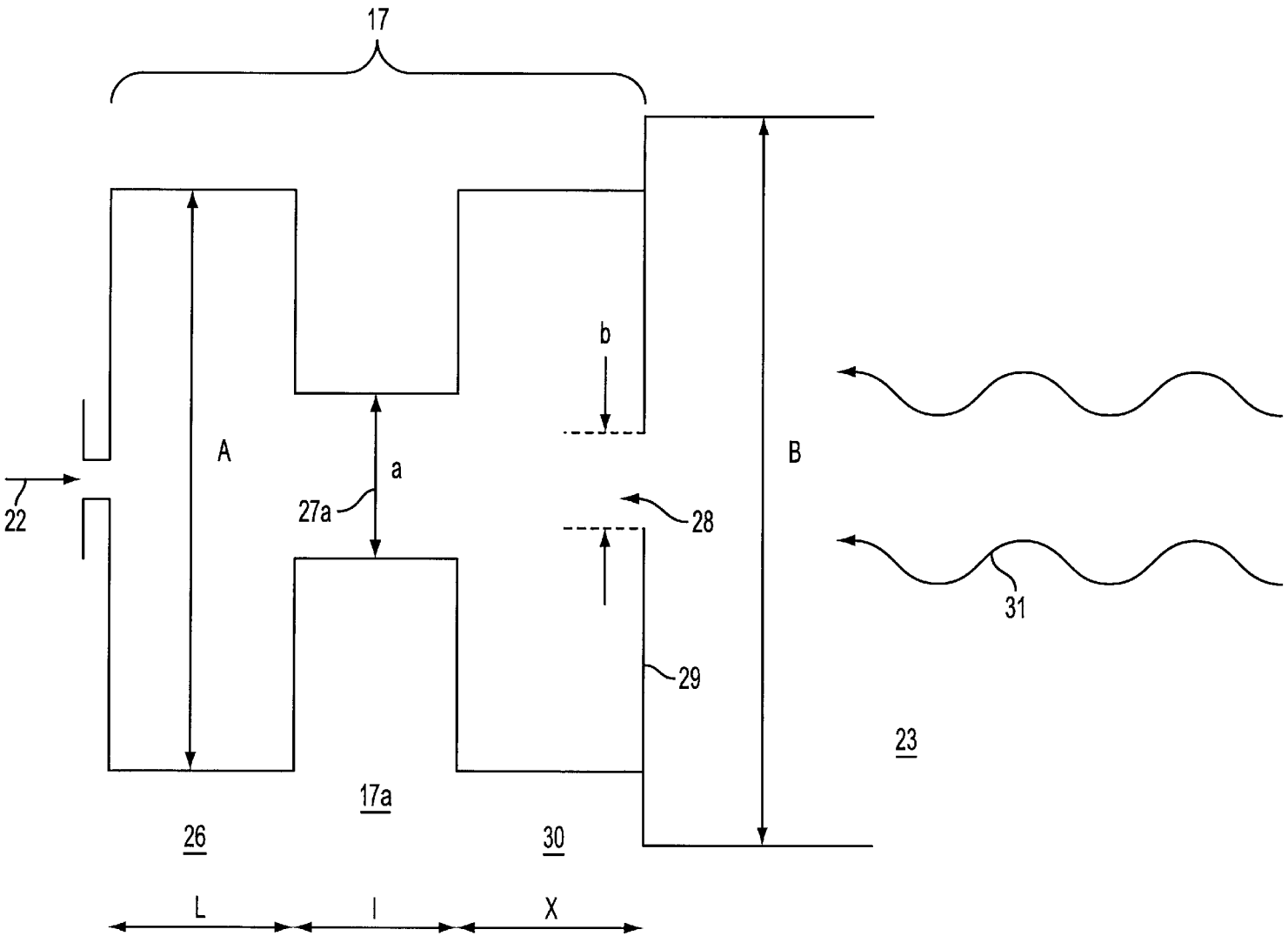
FIG. 4 shows a simplified minimal calculation unit for an arrangement as shown in FIG. 2, with external damping diaphragm.

In addition to forming the boundary of the first intermediate volume, the first perforated plate 24 has two further important duties. The openings 25 provided in the first perforated plate 24 permit cooling air to flow from the rear cooling air duct 16 into the first intermediate volume 26. On the one hand, the entering cooling air cools the Helmholtz resonator arrangement. The geometry, and therefore the damping frequency, of the arrangement is kept stable by this means. On the other hand, the openings 25 are offset relative to the second openings 27*a* or are arranged "on gap". In consequence, the cooling air flowing into the first intermediate volume 26 impinges on the outside of the second perforated plate 17*a* opposite to the openings 25, which leads to effective impingement cooling of the second perforated plate 17. The diameter of the openings 25 is comparatively small relative to the diameter a (FIG. 4). This ensures that the cooling air flowing through them suffers a sufficient pressure drop.

In addition, as shown in FIG. 2, a third perforated plate 29 is arranged in parallel and at a distance (X in FIG. 4) on the inside of the second perforated plate 17*a*. This third perforated plate 29, together with the second perforated plate 17*a,* encloses a second (annular) intermediate volume 30. The third perforated plate 29 has a plurality of distributed openings 28. These openings 28 are preferably configured in such a way that the third perforated plate 29 allows the noise arising in the combustion zone 23 to pass without echo, i.e. no noise is reflected and, in consequence, this third perforated plate acts in a noise-absorbing manner. The second intermediate volume 30 and the third perforated plate have, flowing through them, the cooling air flowing through the first intermediate volume and the second openings 27*a* and are correspondingly cooled.

Figure 3:
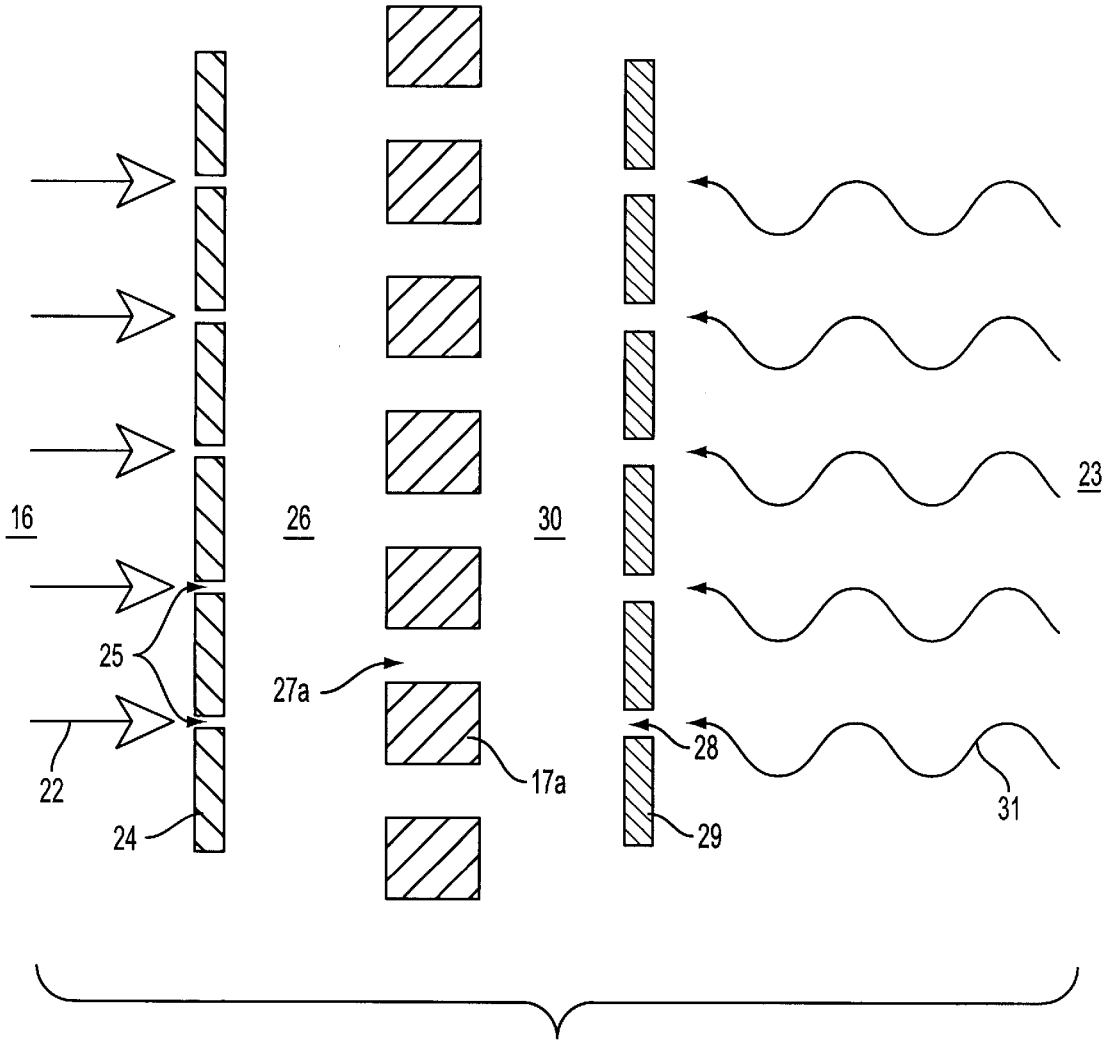
FIG. 3 shows a diagrammatic representation of a section of the arrangement shown in FIG. 2.

FIG. 3 again shows, diagrammatically, the construction of the embodiment example of the invention illustrated in FIG. 2. The noise 31 arriving from the combustion zone 23 initially passes without echo through the openings 28 of the third perforated plate 29 into the second intermediate volume 30. The noise then meets the Helmholtz resonators formed by the first perforated plate 24 and the second perforated plate 17*a* with the openings 27*a,* which displace the phase of the sound waves. At the same time, the cooling airflow 22—after it has passed through the openings 25 in the first perforated plate 24 into the first intermediate volume 26—flows through the arrangement in the opposite direction to the noise.

A diagrammatic representation of the arrangement, which is particularly suitable for calculating its properties, is represented, together with information on the dimensions, in FIG. 4. The essential properties of this sequencing of elements can be determined by simply calculating the transformation behavior of the Riemann invariants for each element and by subsequently sequencing the transformations. In this connection, a particularly important property of the noise-absorbing perforated plate is that the transmission of the noise-absorbing perforated plate for low Mach number flow is echo-free, i.e. reflection-free, precisely when the contraction ratio, defined as the ratio of the area of the orifice or of the opening b to the area B before the orifice (b/B) is essentially equal to the highest Mach number occurring in the chamber.

The resonant frequency of the resonator arrangement or of the partial resonators is essentially determined by the area A, the thickness I of the second perforated plate 17*a* or the length of the openings 27*a,* the diameter of the openings 27*a* and the distance L between the plates. In order to damp frequencies in the range of a few kHz, the openings 27*a* are configured as through-holes with a length I of a few millimeters and a diameter a of a few millimeters. The distance L between the first perforated plate 24 and the second perforated plate 17*a* is a few millimeters and the ratio of the area A to the perforation area a is in the range from 5 to 10.

The values listed in the following table can be given as examples for the damping of frequencies in the range from 2 to 6 kHz:

| Inlet values | |
|---|---|
| Temperature of the air | 770 K |
| Hole length I | 6 mm |
| Distance between plates L | 6 mm |
| Distance between plates X | 6 mm |
| Area ratio A/a | 8 |
| Area ratio B/A | 1 |
| Product of Mach number and inverse contraction ratio | 1 |
| Mass flow of the cooling air | 3.88 kg/(s*m$^2$) |
| Pressure in the burner | 16.6 bar |

| Outlet values | |
|---|---|
| Flow velocity in the openings 27a | 4.13 m/s |
| Inverse contraction ratio | 32.81 |
| Flow velocity through the third perforated plate 29 | 16.94 m/s |

Figure 5A:
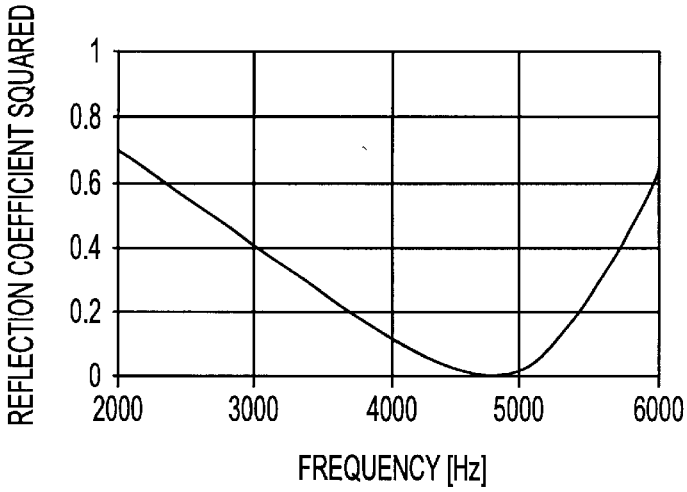
FIG. 5 shows the reflection coefficient squared as a function of the frequency in various arrangements with external damping diaphragm.

The damping behavior provided by the values in the table for the arrangement of Helmholtz resonators and noise-absorbing perforated plate 29 is given in FIG. 5*a*). In each case, FIG. 5 shows the reflection coefficient squared plotted against the frequency in Hz. It may be seen in FIG. 5*a*) that significant absorption takes place for the above values in the whole of the range from 2 to 6 kHz and that resonant absorption takes place at 4720 Hz. There is very strong absorption in the range from 3.5 to 5.5 kHz, when more than 75% of the acoustic power is taken up.

Figure 5B:
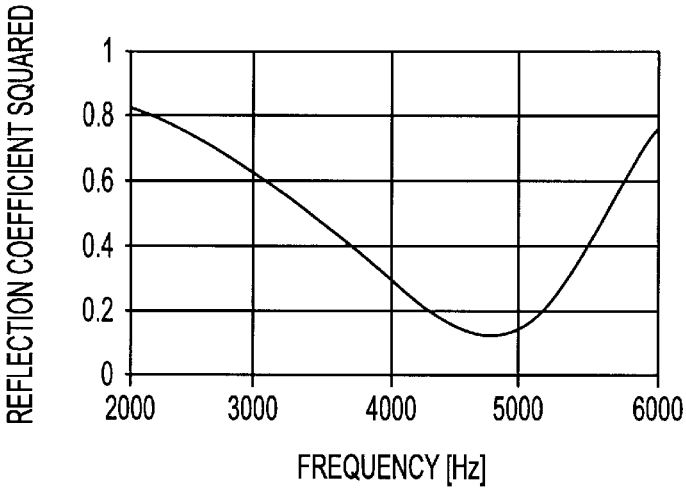

If, from the above inlet values, the area ratio B/A only is altered, to 2, i.e. the ratio of the burner area to the damping area is reduced, an absorption behavior results as given in FIG. 5*b*), whereas the outlet values given in the table are not changed. The noise absorption generally decreases and there is no longer any resonant absorption. This shows that it is always necessary to take account of the complete arrangement and that it is not possible to consider Helmholtz resonators and noise-absorbing plates separately. In order to again correct the detuning of the system caused by the above modification, the third perforated plate must be modified, in addition to B/A=2, namely, the product of the Mach number and the inverse contraction ratio must be set to 0.5. The following new outlet values are then obtained:

| Outlet values | |
|---|---|
| Inverse contraction ratio | 23.21 |
| Flow velocity through the third perforated plate 29 | 11.98 m/s |

Figure 5C:
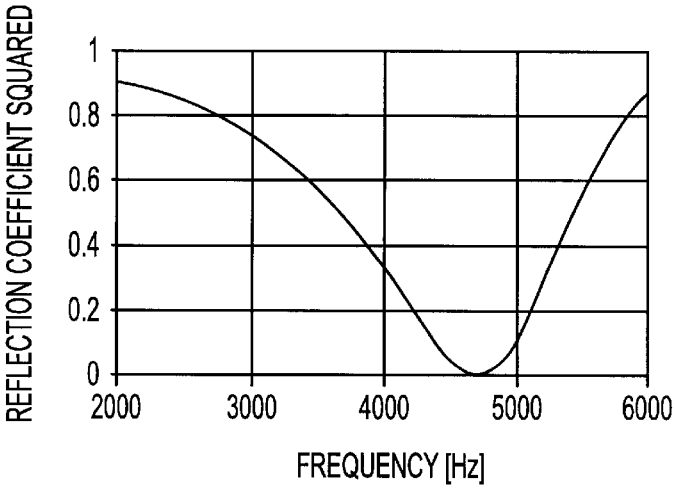

This reduction in the flow velocity through the third perforated plate 29 results in a behavior as shown in FIG. 5*c*). A resonant absorption is again observed at approximately the same frequency even if the region of strong absorption has become narrower, as compared with FIG. 5*a*), because the contraction ratio is no longer optimally matched to the maximum Mach number.

Figure 6:
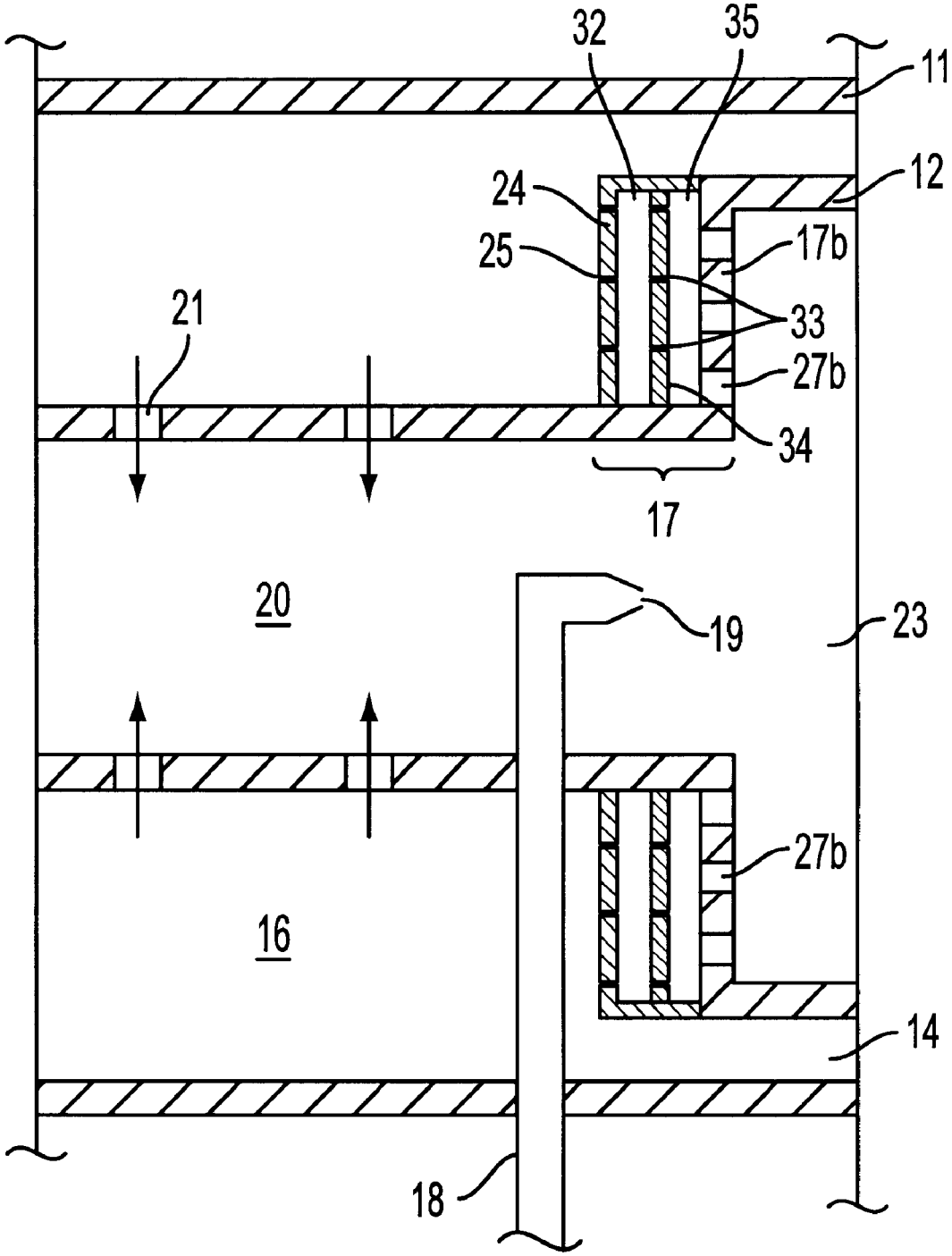
FIG. 6 shows an enlarged excerpt from the combustion chamber of FIG. 1 in the region of the step-type transition between the inlet zone and the combustion zone with an integrated Helmholtz resonator arrangement and an internally arranged damping diaphragm in accordance with a preferred embodiment example of the invention.

A further configuration example of an embodiment of the invention is shown in FIG. 6. In this case, a so-called internal absorber is involved, i.e. the noise-absorbing diaphragm is located within the actual damping volume of the Helmholtz resonators. In this case, the Helmholtz resonators are formed from a first perforated plate 24 facing toward the rear cooling air duct 16 and a third perforated plate 17*b* bordering directly on the combustion zone 23. The first perforated plate 24 again has openings 25 through which cooling air 22 flows into the arrangement. The third perforated plate 17*b* has openings 27*b* which act as damping tubes of the Helmholtz resonators. The damping volume of the Helmholtz resonators is composed, in this case, of the two intermediate volumes 32 and 35, which are formed by the second perforated plate 34 which is inserted between the first perforated plate 24 and the third perforated plate 17*b*. The second perforated plate 34 is provided with openings 33 which are configured in such a way that this second perforated plate 34 acts in a noise-absorbing, i.e. echo-free, manner. This, as described above, by a contraction ratio matched to the maximum Mach number.

Figure 7:
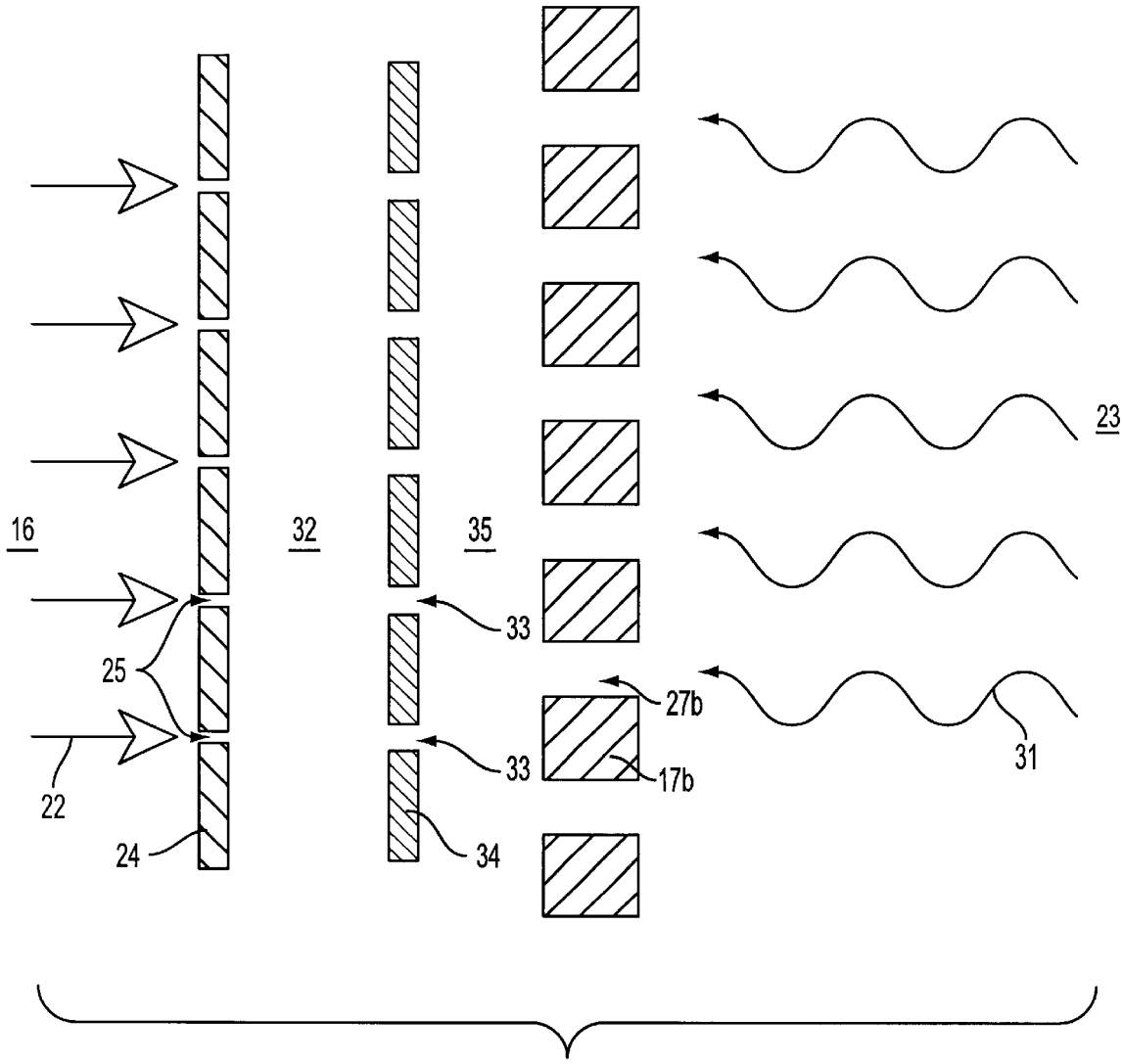
FIG. 7 shows a diagrammatic representation of a section of the arrangement shown in FIG. 6.
Figure 8:
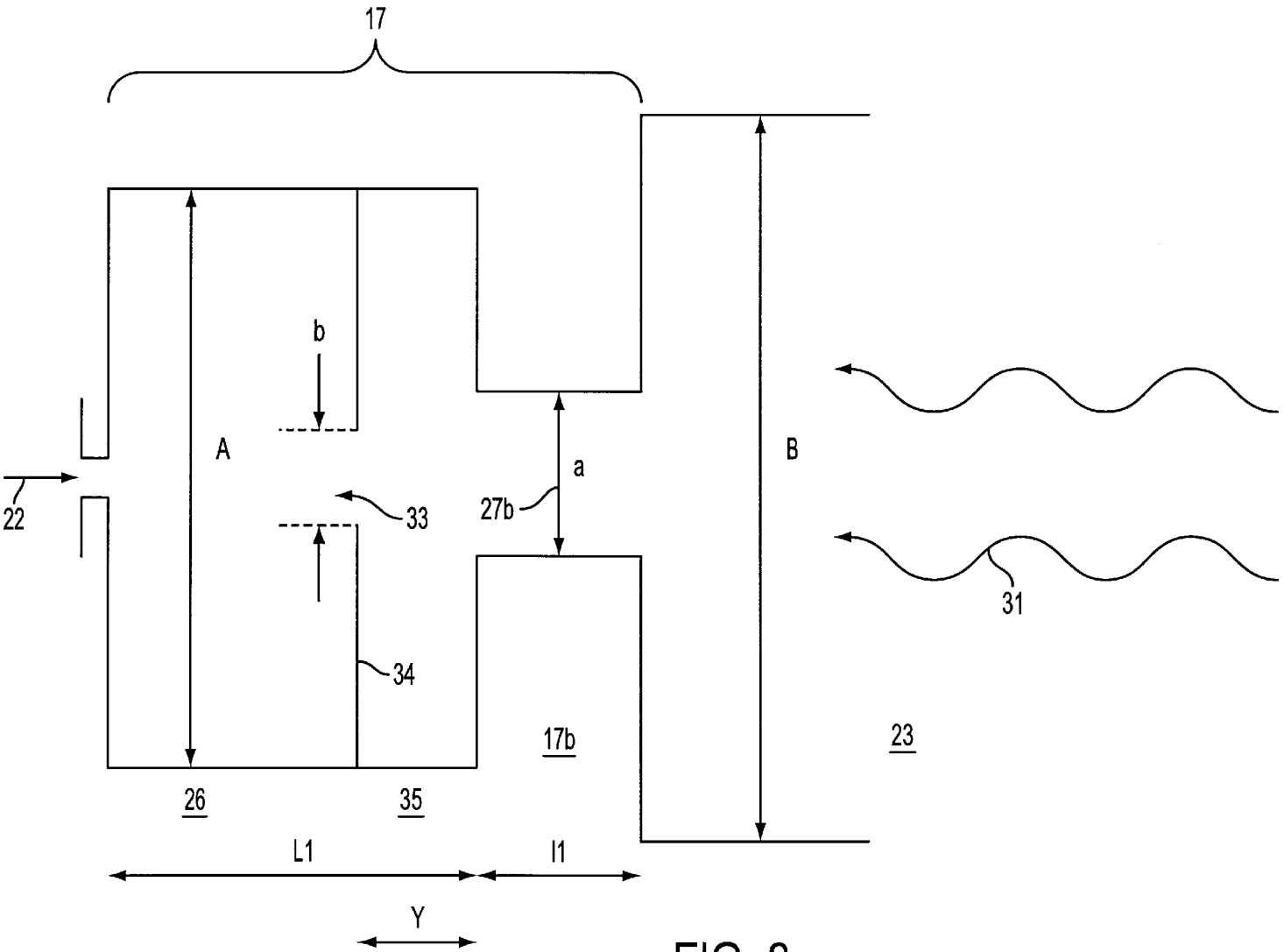
FIG. 8 shows a simplified minimal calculation unit for an arrangement as shown in FIG. 6, with internal damping diaphragm.

FIG. 7 again shows a diagrammatic representation of how the noise 31 impinges from the combustion zone 23 onto the arrangement with internal absorber and how the cooling air 22 flows from the opposite side through the openings 25. The simplest representation of the elements for calculating the most important characteristic properties of such an arrangement is provided, together with the dimensions, in FIG. 8, by analogy with FIG. 4. The resonant frequency of the resonator arrangement or of the partial resonators is essentially determined, in this case, by the area A, the thickness I1 of the third perforated plate 17*b* or the length of the openings 27*b*, the diameter of the openings 27*b* and the distance apart L1 of the plates. In order to damp frequencies in the range of a few kHz, the openings 27*b* are configured as through-holes with a length I1 of a few millimeters and a diameter a of a few millimeters. The distance L1 between the first perforated plate 24 and the third perforated plate 17*b* is a few millimeters and the ratio of the area A to the perforation area a is in the range from 5 to 10.

The values listed in the following table can be given as examples for the damping of frequencies in the range from 2 to 6 kHz:

| Inlet values | |
|---|---|
| Temperature of the air | 770 K |
| Hole length I1 | 6 mm |
| Distance between plates L1 | 8 mm |
| Distance between plates Y | 3 mm |
| Area ratio A/a | 8 |
| Area ratio B/A | 1 |
| Product of Mach number and inverse contraction ratio | 2.025 |
| Mass flow of the cooling air | 3.88 kg/(s*m$^2$) |
| Pressure in the burner | 16.6 bar |

| Outlet values | |
|---|---|
| Flow velocity in the openings 27b | 4.13 m/s |
| Inverse contraction ratio | 46.68 |
| Flow velocity through the second perforated plate 34 | 24.10 m/s |

Figure 9A:
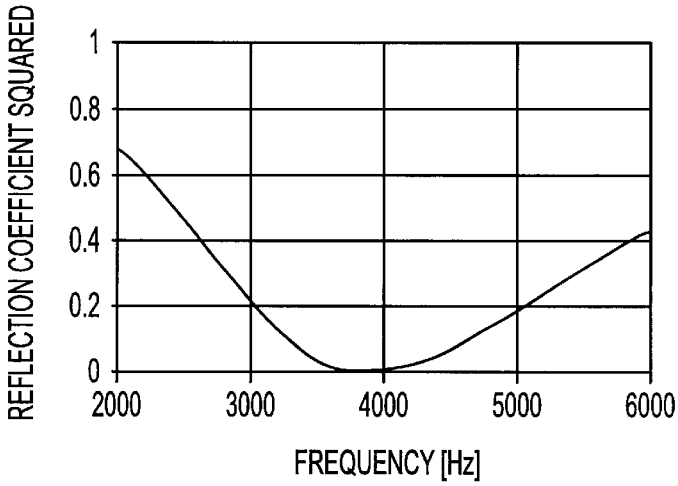
FIG. 9 shows the reflection coefficient squared as a function of the frequency in various arrangements with internal damping diaphragm.

The damping behavior provided by the values in the table for the arrangement of Helmholtz resonators and internal noise-absorbing perforated plate 34 is given in FIG. 9*a*). In each case, FIG. 9 again shows the reflection coefficient squared plotted against the frequency in Hz. It may be seen in FIG. 9*a*) that significant absorption takes place for the above values in the whole of the range from 2 to 6 kHz and that resonant absorption takes place at 3880 Hz. There is very strong absorption in the range from 2.9 to 5.2 kHz, when more than 75% of the acoustic power is taken up.

Figure 9B:
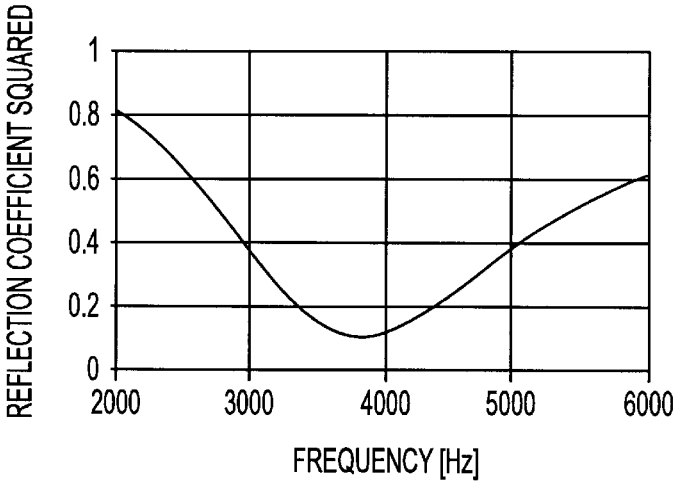

If, from the above inlet values, the area ratio B/A only is altered, to 2, i.e. the ratio of the burner area to the damping area is reduced, an absorption behavior results as given in FIG. 9*b*), whereas the outlet values given in the table are not changed. The noise absorption generally decreases and there is no longer any resonant absorption. In order to again correct the detuning of the system caused by the above modification, the second perforated plate 34 must be modified, in addition to B/A=2, namely, the product of the Mach number and the inverse contraction ratio must be set to 0.981. The following new outlet values are then obtained:

| Outlet values | |
|---|---|
| Inverse contraction ratio | 32.50 |
| Flow velocity through the second perforated plate 34 | 16.78 m/s |

Figure 9C:
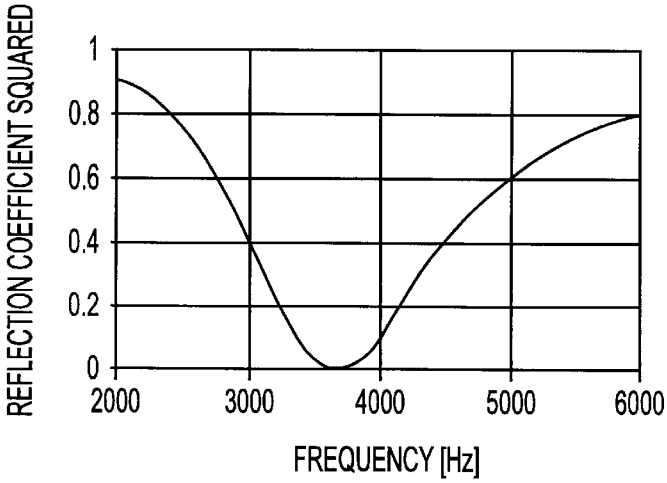

This reduction in the flow velocity through the second perforated plate 34 results in a behavior as shown in FIG. 9*c*). A resonant absorption is again observed at approximately the same frequency even if the region of strong absorption has become narrower, as compared with FIG. 9*a*), because the contraction ratio is no longer optimally matched to the maximum Mach number.

If the characteristics of internal and external absorbers are respectively compared for the first inlet values, it may be seen that the absorption increases relatively slowly between 2 and 4.5 kHz in the case of the external absorber and decreases rapidly above 5.2 kHz, whereas the absorption increases rapidly between 2 and 3.5 kHz in the case of the internal absorber and only decreases slowly above 4.5 kHz. The absorption behavior of an arrangement with internal absorber is therefore not only more symmetrical but it also generally exhibits a wider absorption. One or other arrangement can, however, be better suited depending on the application and the noise frequencies involved.

Figure 10:
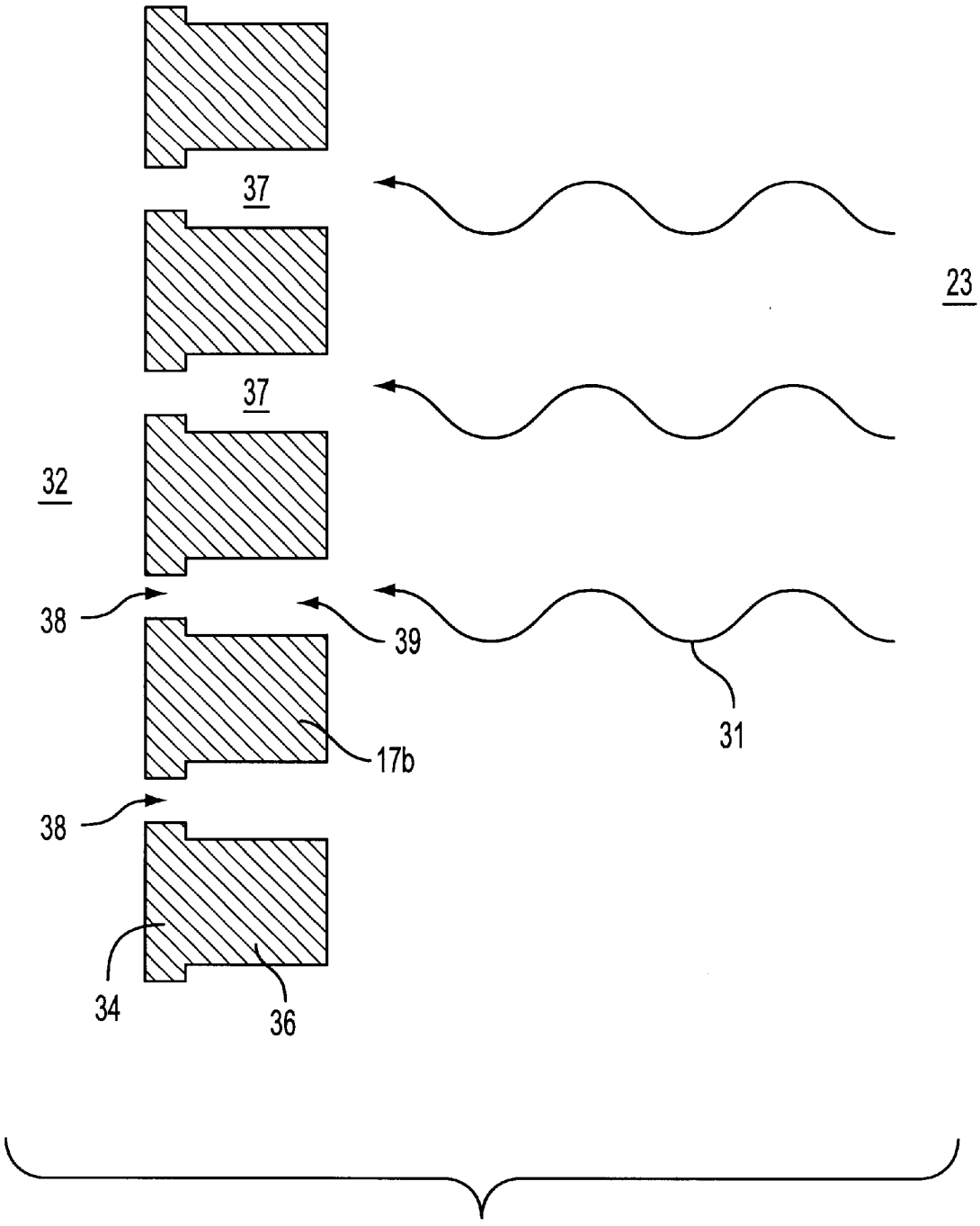
FIG. 10 shows a section through a perforated diaphragm, which replaces the second and the third perforated diaphragms in the case of an internal damping diaphragm.

Because the cooling, particularly that of the wall subjected to the combustion zone 23, can no longer be produced in an optimum manner in the case of an arrangement with three perforated plates at a distance from one another, it can be found advantageous, in accordance with a further embodiment of the invention, to arrange the noise-absorbing perforated plate and the perforated plate which forms the damping tubes of the Helmholtz resonators directly in contact with one another, or even to replace them by one perforated plate 36 provided with special, stepped openings. Such a perforated plate 36 is shown in FIG. 10 for an arrangement with internal absorber. The perforated plate 36 has openings 37 of different diameters from the two sides, the second stepped part 39 facing toward the combustion zone 23 having to simulate the damping tubes 27*b* from FIG. 6 and the other, first stepped part 38 ensuring the echo-free transmission and corresponding to the openings 33 of FIG. 6. This provides the advantage of only having to provide two perforated plates, which substantially simplifies the cooling and the design and nevertheless permits an efficient combined arrangement of Helmholtz resonators and noise absorbers.

All the above embodiment examples feature the fact that they can be installed in a simple manner in an existing combustion chamber. In the embodiment examples described here, the previous radial inner wall 17 is used once as the second perforated plate 17*a* and once as the third perforated plate 17*b* of the three-part arrangement. The previous radial inner wall 17 can of course, however, undertake the duty of each of the three perforated plates or even the perforated plate 36 with stepped openings. Depending on the space relationships and the holes 22 already present in the radial inner wall 17, the retrofitting can therefore be undertaken in one way or the other.

Numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A combustion chamber for a gas turbine, said combustion chamber comprising inner walls inside of which hot combustion gases of a combustion zone are cooled by cooling air, said cooling air being introduced into said combustion zone through cooling air ducts outside the inner walls, said cooling air ducts being formed by an outer wall of the combustion chamber and the inner walls, wherein, at least in a partial region of the inner walls, the inner walls are formed from at least two perforated plates arranged substantially parallel to one another, wherein a first perforated plate borders directly on the cooling air ducts and is provided with a plurality of first openings through which said cooling air from the cooling air ducts flows into an intermediate volume located behind the first perforated plate, wherein a further perforated plate is arranged behind the first perforated plate in the direction of the combustion zone, said further perforated plate being provided with a plurality of further openings, wherein the distance between the first perforated plate and the further perforated plate and the geometrical dimensions of the further openings are selected such that the openings, together with said intermediate volume present between the perforated plates, form a plurality of mutually connected Helmholtz resonators and act as noise dampers for acoustic vibrations occurring in the combustion chamber, and wherein in addition further means are present which act to absorb noise.

2. The combustion chamber as claimed in claim 1, wherein, at least in a partial region of the inner walls, the inner wall is formed from three perforated plates arranged substantially parallel to one another, the first perforated plate bordering directly on the cooling air ducts and being provided with a plurality of first openings through which cooling air from the cooling air ducts flows into a first intermediate volume being located behind the first perforated plate, said first intermediate volume is bounded, on the side facing toward the cooling air ducts, by the first perforated plate and, on the opposite side, by a second perforated plate, said second perforated plate being provided with a plurality of second openings, wherein the third perforated plate is arranged on the side of the second perforated plate facing away from the first intermediate volume, said third perforated plate being provided with a plurality of third openings and borders on the combustion zone, and wherein at least one of the perforated plates acts to absorb noise.

3. The combustion chamber as claimed in claim 2, wherein a contraction ratio, defined as the ratio between the area of the opening and the area located in front of the opening in the direction of the combustion zone, is substantially the same for the second or the third openings as the maximum Mach number occurring in the combustion space, said Mach number being defined as the ratio of the source velocity and the sonic velocity, and wherein the perforated plate provided with such openings acts in a noise-absorbing manner.

4. The combustion chamber as claimed in claim 2, wherein a second intermediate volume is formed between the second and the third perforated plates.

5. The combustion chamber as claimed in claim 2, wherein the distance between the first perforated plate and the second perforated plate and the geometrical dimensions of the second openings are selected such that the second openings, in combination with the first intermediate space arranged between the first and the second perforated plates, provide Helmholtz resonators whose resonant frequency is substantially located within the range of the acoustic vibrations occurring in the combustion space.

6. The combustion chamber as claimed in claim 3, wherein the third perforated plate is configured to absorb noise.

7. The combustion chamber as claimed in claim 6, wherein the second perforated plate has a thickness in the range from 0.1 to 1 cm, wherein the area ratio of acoustically relevant partial areas of the first intermediate volume and the areas of the second openings is in the range from 5 to 10, wherein the distance of the first from the second perforated plate is 0.1 to 1 cm, wherein the product of the contraction ratio of the third openings and the maximum Mach number is in the range from 1 to 0.5, and wherein the area ratio of acoustically relevant partial areas in the combustion space and the acoustically relevant partial areas of the first intermediate volume is in a range from 1 to 2, so that the Helmholtz resonators, in combination with the noise-absorbing perforated plate, absorb acoustic vibrations occurring in the combustion space with frequencies in the range from 2 to 6 kHz.

8. The combustion chamber as claimed in claim 2, wherein the distance between the first perforated plate and the third perforated plate and the geometrical dimensions of the third openings are selected such that the third openings, in combination with an intermediate space arranged between the first and the third perforated plate, provide Helmholtz resonators whose resonant frequency is essentially located within the range of the acoustic vibrations occurring in the combustion space.

9. The combustion chamber as claimed in claim 3, wherein the second perforated plate is configured to absorb noise.

10. The combustion chamber as claimed in claim 9, wherein the third perforated plate has a thickness in the range from 0.1 to 1 cm, wherein the area ratio of acoustically relevant partial areas of the intermediate volume and the areas of the third openings is in the range from 5 to 10, wherein the distance of the first from the third perforated plate is 0.1 to 1 cm, wherein the product of the contraction ratio of the second openings and the maximum Mach number is in the range from 2.5 to 0.5, and wherein the area ratio of acoustically relevant partial areas in the combustion space and the acoustically relevant partial areas of the first intermediate volume is in a range from 1 to 2, so that the Helmholtz resonators, in combination with the noise-absorbing perforated plate, absorb acoustic vibrations occurring in the combustion space with frequencies in the range from 2 to 6 kHz.

11. The combustion chamber as claimed in claim 2, wherein one of the second and the third perforated plates lies directly one above the other, and wherein the second and the third openings are arranged to be equally distributed and concentric.

12. The combustion chamber as claimed in claim 11, wherein the second and the third perforated plates are formed by a perforated diaphragm having stepped openings and first and second stepped parts, said first stepped parts facing toward the first perforated plate correspond to the second openings and said second stepped parts facing toward the combustion space correspond to the third openings.

13. A combustion chamber for a gas turbine, said combustion chamber comprising:

inner walls and outer walls, said inner walls surrounding a combustion zone inside of which hot combustion gases are cooled by cooling air, said cooling air being introduced into said combustion zone through cooling air ducts provided outside the inner walls, said cooling air ducts being formed by said outer walls and said inner walls;

at least a partial region of the inner walls being formed from a first and a second perforated plate having intermediate volumes therebetween, said first and second perforated plates being arranged substantially parallel to one another, wherein said first perforated plate borders directly on the cooling air ducts and is provided with a plurality of first openings through which said cooling air from the cooling air ducts flows into a first intermediate volume located behind the first perforated plate, wherein a second perforated plate is arranged behind the first perforated plate in the direction of the combustion zone, said second perforated plate being provided with a plurality of second openings, wherein the distance between the first perforated plate and the second perforated plate and the geometrical dimensions of the second openings are selected such that the openings, together with said intermediate volumes present between the perforated plates, form a plurality of mutually connected Helmholtz resonators and act as noise dampers for acoustic vibrations occurring in the combustion chamber, and wherein additional means are present which act to absorb noise.

14. The combustion chamber as claimed in claim 7, wherein the second perforated plate has a thickness of about 0.6 cm, wherein the area ratio of acoustically relevant partial areas of the first intermediate volume and the areas of the second openings is about 8, and wherein the distance of the first from the second perforated plate is about 0.6 cm.

15. The combustion chamber as claimed in claim 10, wherein the third perforated plate has a thickness of about 0.6 cm, wherein the area ratio of acoustically relevant partial areas of the intermediate volume and the areas of the third openings is about 8, and wherein the distance of the first from the third perforated plate is about 0.6 cm.

* * * * *